US005720363A

United States Patent [19]

Kipp

[11] Patent Number: 5,720,363

[45] Date of Patent: Feb. 24, 1998

[54] SYSTEM AND METHOD FOR AUTOMATIC ORDERING AND DIRECT UNDERGROUND DISTRIBUTION OF ARTICLES TO CUSTOMERS

[76] Inventor: Ludwig Kipp, 235 Dunbar Rd., Palm Beach, Fla. 33480

[21] Appl. No.: 573,462

[22] Filed: Dec. 15, 1995

[51] Int. Cl.[6] ..... B61L 27/04

[52] U.S. Cl. ..... 186/55; 235/383

[58] Field of Search ..... 186/38, 52, 55, 186/56, 58, 7, 28; 104/138.1, 88.02, 88.03, 88.04, 88.05, 88.06; 105/365; 235/383

[56] References Cited

U.S. PATENT DOCUMENTS 4,018,410 4/1977 Renaux ..... 104/88.03 X
4,554,873 11/1985 Rex ..... 104/130 X
4,950,119 8/1990 Nord et al. ..... 414/277
5,063,857 11/1991 Kissel ..... 104/130
5,282,424 2/1994 O'Neill ..... 105/365 X
5,362,948 11/1994 Morimoto ..... 235/383 X

*Primary Examiner*—F. J. Bartuska
*Attorney, Agent, or Firm*—Amster, Rothstein & Ebenstein

[57] ABSTRACT

The present invention provides a system and method for computer-controlled, automated shopping which enables an authorized customer to order an article from a central processing center and have the article automatically delivered via an underground tunnel network.

14 Claims, 2 Drawing Sheets

SYSTEM AND METHOD FOR AUTOMATIC ORDERING AND DIRECT UNDERGROUND DISTRIBUTION OF ARTICLES TO CUSTOMERS

BACKGROUND OF THE INVENTION

The present invention relates to a system and method for computer-controlled, automated distribution of articles. In particular, the system and method of the present invention facilitates the purchase and delivery of articles by enabling an authorized customer to order one or more articles from a central processing center and have the article(s) automatically delivered to a location of his or her choice, e.g. a household or business, via an underground transport system.

The system of the present invention is activated when an authorized customer places an order with a central processing center for one or more articles using one of a variety of interactive means of communication such as an automated telephone system or an interactive computer system. The information required for ordering, such as that pertaining to article availability, price and ordering codes is made available to the authorized customer through media outlets e.g. newspaper, radio or television advertising, or fliers distributed by mail or the interactive computer-controlled network.

Once the articles ordered by the authorized customer have been collected, they are loaded into a vehicle for automatic transport to a destination specified by the authorized customer, e.g. a residence or business address, in an underground transport system. The underground transport system of the present invention comprises an interconnecting underground tunnel network which services a defined geographical area, e.g. a city or county, and which allows the automatic, controlled movement of the vehicles between the processing center and their predetermined destination.

Upon arrival at the destination specified by the authorized customer, the vehicle is unloaded and released back into the underground tunnel network for automatic return to the processing center.

Various automatic systems relating to the automatic transportation, storage and retrieval of articles have been disclosed in the prior art. For example, U.S. Pat. No. 4,554,873 issued to Rex ("the '873 Patent") describes a closed transportation system for the handling and sorting of material such as mail. The system of the '873 Patent consists of self powered trolleys which run on a continuous track network. The destination and return routes of the trolleys of the '873 Patent are programmed by an operator at the point of package loading and the trolleys are guided around the network by track-side signposts.

U.S. Pat. No. 5,063,857 ("the '857 Patent") issued to Kissel also describes a transportation system consisting of specially constructed vehicles which have the ability to travel unidirectionally through a grid-patterned network of guideways. The system of the '857 Patent has the ability to transport an individual passenger or a unit of cargo.

U.S. Pat. No. 5,282,424 ("the '424 Patent") issued to O'Neill describes a method and apparatus for ground-based high speed transportation of passengers and/or freight in tunnels. In the transport system of the '424 Patent, passengers and/or freight are transported in vehicles containing a pressurizable cabin which are magnetically levitated as they move through the tunnels.

U.S. Pat. No. 4,950,119 ("the '119 Patent") issued to Nord describes a system for transporting, storing and retrieving goods within a warehouse. In the system of the '119 Patent, goods are loaded onto vehicles designed to move on a track system from a loading point to and from a multi-tier, multi-lane rack storing areas.

The automatic transport systems of the prior art are deficient in providing a viable, automated system for the purchase and delivery of articles. These prior art automatic transport systems do not permit a customer located at a remote location such as his/her residence or business to automatically order articles and have them automatically delivered to his/her residence or business. Furthermore, these prior art systems are more expensive to construct.

The system of the present invention overcomes the disadvantage of prior art automatic transportation systems by providing a computer-controlled, automated system which allows an authorized customer to order specific articles and have them automatically delivered to the destination of his/her choice via an underground transport system which comprises an interconnecting tunnel network dedicated to the transport of articles.

As a result of its underground construction, the system of the present invention reduces the often substantial investment required to acquire above-ground real estate. The underground construction also enables the system to more effectively reach all addressable locations within a defined geographical service area. The underground transport system of the present invention also provides a more environmentally friendly system in that its construction, operation and maintenance does not detrimentally impact on undeveloped areas of an already crowded metropolitan landscape. In addition, the system's speed and efficiency of delivery, derived from its specialization (i.e. it is dedicated to the transport of articles), make it an attractive alternative to purchasing the articles personally at retail establishments.

In addition, by reducing the number of trips to retail establishments for the purchase of articles, the system of the present invention has the potential to significantly decrease the volume of vehicular traffic on the roads of the towns and cities that it serves and the highways which connect them. This reduction in the number of automobiles, especially at peak hours, leads to the more efficient and orderly movement of essential traffic such as commuter, emergency and service vehicles and a concomitant decrease in the incidence of injuries and fatalities associated with automobile accidents in areas of high traffic volume. The reduction in traffic load also benefits the infrastructure of the area serviced by the system by increasing the lifespan of its roads and highways as well as the length of time between repairs associated with their routine maintenance.

Furthermore, implementation of the system of the present invention also provides positive environmental and societal benefits. The reduced use of automobiles leads to a decrease in noise and air pollution and also helps to conserve our finite reserves of fossil fuels. In addition, the system frees individual members of society from time consuming activities associated with purchasing articles, e.g., travelling to and from the retail establishment, choosing the article, and waiting in line to complete the transaction. By doing so, implementation of the system of the present invention allows those individuals to devote more time to family-related and recreational activities.

In summary, the present invention obviates the need for individual members of society to expend precious resources in terms of both energy and time making frequent trips to and from retail establishments to purchase articles. The present invention also allows greater efficiency and so lowers the cost involved in the management of retail and wholesale establishments by automating many of the time consuming tasks currently performed by employees.

SUMMARY OF THE INVENTION

It is an object of the present invention to provide a computer-controlled, automated system for the distribution of articles upon demand.

It is a further object of the present invention to provide a transportation system for the movement of vehicles between a central processing center and a destination specified by an authorized customer within an interconnecting underground tunnel network.

It is a further object of the present invention to provide an interconnecting underground tunnel network capable of automatically transporting vehicles containing one or more article(s) ordered by an authorized customer from a central processing center to the destination of his or her choice.

It is a further object of the present invention to provide an interconnecting underground tunnel network capable of servicing all addressable locations within a designated service area.

It is further object of the present invention to provide an economical automatic transport system for the distribution and delivery of articles.

It is a further object of the present invention to provide a method for the automatic distribution of articles ordered by an authorized customer from a central processing center to a destination specified by the authorized customer using an interconnecting underground tunnel network.

In accordance with one embodiment of the present invention, a computer-controlled, automated shopping system for distributing an article from a processing center to an authorized customer upon demand comprising: (a) ordering means, whereby an authorized customer can order an article from a processing center; (b) underground distribution means including a transport system connecting the processing center with a delivery location specified by the authorized customer and a vehicle operable on the underground distribution means for automatically conveying the article from the processing center to the delivery location; and (c) means whereby the vehicle is thereafter returned to the processing center after unloading of the article at the delivery location, is provided.

In accordance with another embodiment of the present invention, a computer-controlled, automated shopping system for distributing an article from a processing center to an authorized customer upon demand comprising: (a) ordering means, whereby an authorized customer can order an article from a processing center; (b) accounting means, whereby an authorized customer can pay for the article, such accounting means comprising account credit and/or debit means; (c) underground distribution means including a transport system connecting the processing center with a delivery location specified by the authorized customer and a vehicle operable on the underground distribution means for automatically conveying the article from the processing center to the delivery location; and (d) means whereby the vehicle is thereafter returned to the processing center after unloading of the article at the delivery location, is provided.

In accordance with another embodiment of the present invention, a computer-controlled, automated shopping system for distributing an article from a processing center to an authorized customer upon demand comprising: (a) ordering means, whereby an authorized customer can order an article from a processing center; (b) underground distribution means including a transport system connecting the processing center with a delivery location specified by the authorized customer and a vehicle operable on the distribution means for automatically conveying the article from the processing center to the delivery location; (c) signalling means, whereby the arrival of the vehicle at the delivery location is indicated; and (d) means whereby the vehicle is thereafter returned to the processing center after unloading of the article at the delivery location, is provided.

In accordance with another embodiment of the present invention, a computer-controlled, automated shopping system for distributing an article from a processing center to an authorized customer upon demand comprising: (a) ordering means, whereby an authorized customer can order an article from a processing center; (b) retrieval means, whereby the article can be retrieved from a storage area and placed in a vehicle adapted for automatic transport within an underground distribution means; (c) underground distribution means including a transport system connecting the processing center with a delivery location specified by the authorized customer and a vehicle operable on the underground distribution means for automatically conveying the article from the processing center to the delivery location; and (d) means whereby the vehicle is thereafter returned to the processing center after unloading of the article at the delivery location, is provided.

It is also an object of the present invention to provide a computer-controlled, automated shopping system for distributing an article from a processing center to an authorized customer upon demand comprising: (a) ordering means, whereby an authorized customer can order an article from a processing center; (b) accounting means, whereby an authorized customer can pay for the article, the accounting means comprising account credit and/or debit means; (c) retrieval means, whereby the article can be retrieved from a storage area and placed in a vehicle adapted for automatic transport within an underground distribution means; (d) underground distribution means including a system connecting the processing center with a delivery location specified by the authorized customer and a vehicle operable on the underground distribution means for automatically conveying the article from the processing center to the delivery location; (e) signalling means, whereby arrival of the vehicle at the delivery location is indicated; and (f) means whereby the vehicle is thereafter returned to the processing center after unloading of the article at the delivery location, is provided.

In accordance with another embodiment of the present invention, a method for computer-controlled, automated shopping whereby an article can be distributed from a processing center to an authorized customer upon demand, comprising the steps of: (a) receiving an order for an article from an authorized customer; (b) placing the article in a vehicle adapted for automatic transport in an underground transport system; (c) transporting the article in the vehicle to a predetermined destination specified by the authorized customer; and (d) returning the vehicle to the processing center after unloading of the article, is provided.

In accordance with another embodiment of the present invention, a method for computer-controlled, automated shopping whereby an article can be distributed from a processing center to an authorized customer upon demand, comprising the steps of: (a) receiving an order for an article from an authorized customer; (b) placing the article in a vehicle adapted for automatic transport in an underground transport system; (c) transporting the article in the vehicle to a predetermined destination specified by the authorized customer; (d) signalling the arrival of the vehicle at the predetermined location; and (e) returning the vehicle to the processing center after unloading of the article, is provided.

In accordance with another embodiment of the present invention, a method for computer-controlled, automated shopping whereby an article can be distributed from a processing center to an authorized customer upon demand, comprising the steps of: (a) receiving an order for an article from an authorized customer; (b) retrieving the article from a storage area; (c) placing the article in a vehicle adapted for automatic transport in an underground transport system; (d) transporting the article in the vehicle to a predetermined destination specified by the authorized customer; and (e) returning the vehicle to the processing center after unloading of the article, is provided.

In accordance with still another embodiment of the present invention, a method for computer-controlled, automated shopping whereby an article can be distributed from a processing center to an authorized customer upon demand, comprising the steps of: (a) receiving an order for an article from an authorized customer; (b) retrieving the article from a storage area; (c) placing the article in a vehicle adapted for automatic transport in an underground transport system; (d) transporting the article in the vehicle to a predetermined destination specified by the authorized customer; (e) signalling the arrival of the vehicle at the predetermined location; and (f) returning the vehicle to the processing center after unloading of the article, is provided.

The foregoing and various other objects and embodiments of the present invention will appear in the course of the description which is rendered below with reference to the accompanying drawings.

DETAILED DESCRIPTION OF THE INVENTION

Figure 1:
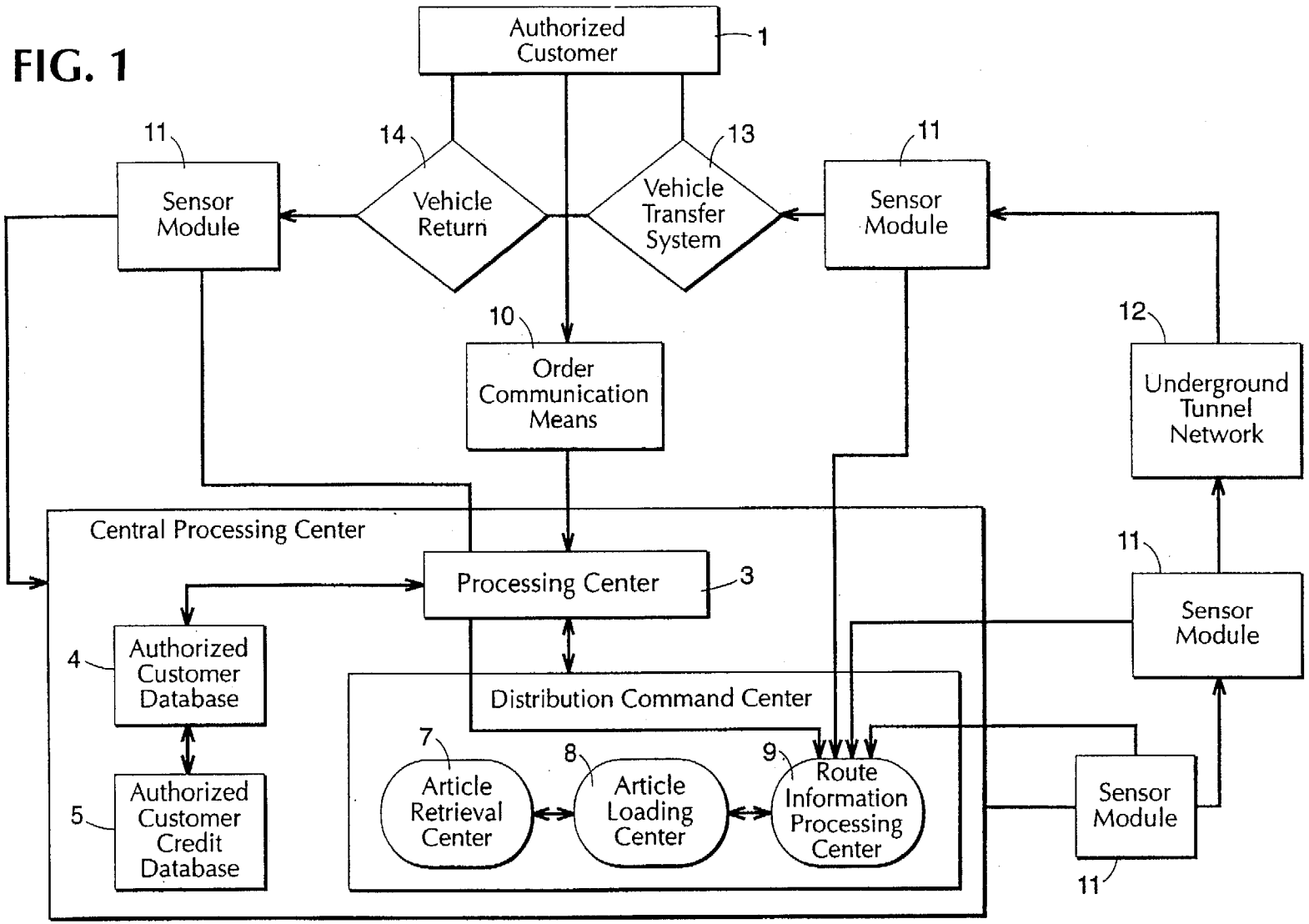
FIG. 1 is a general block diagram showing an overview of the system for computer-controlled, automated shopping according to one embodiment of the present invention.
Figure 2:
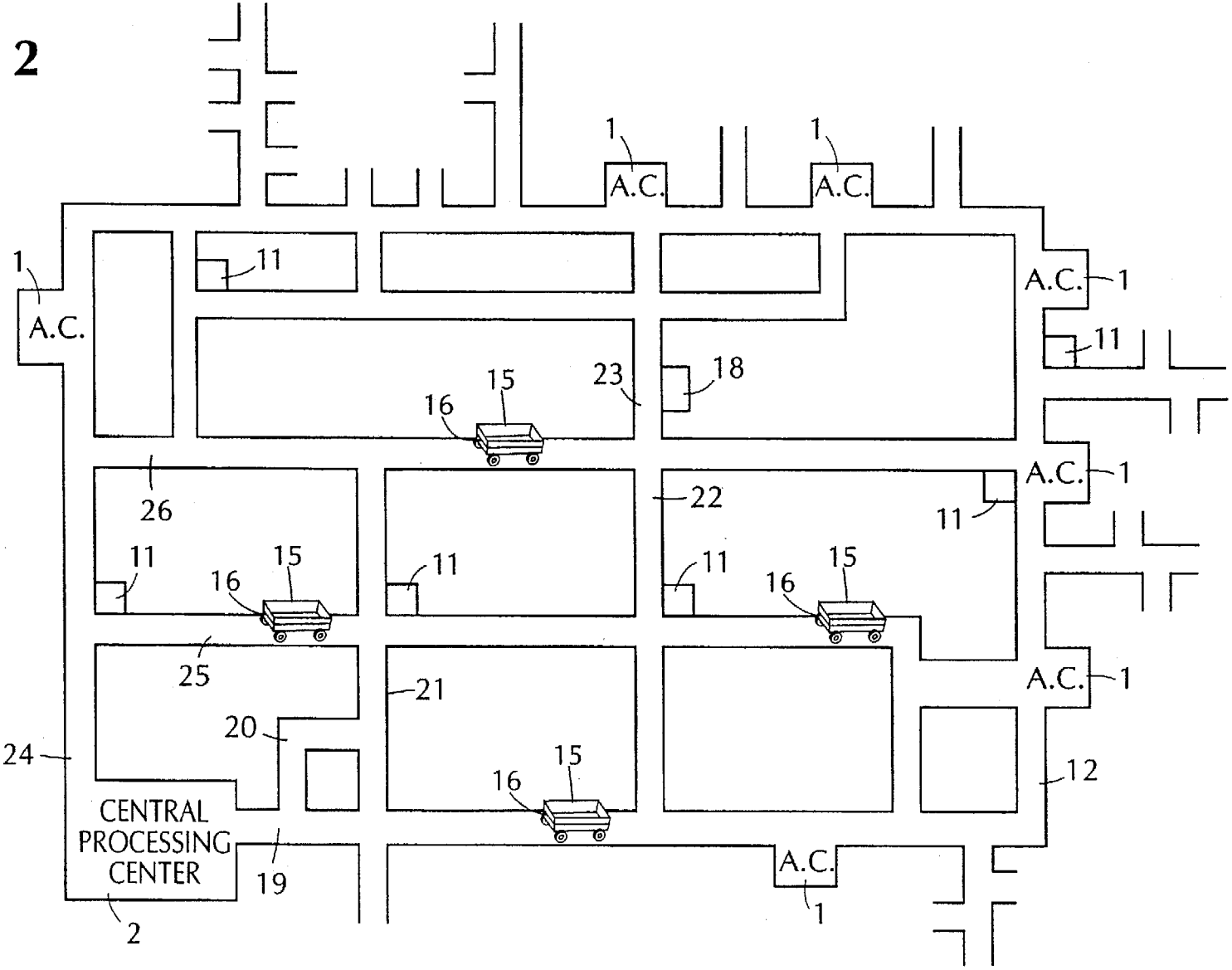
FIG. 2 is a simplified schematic illustration showing an arrangement of the interconnecting underground tunnel system in one embodiment of the present invention. The Figure highlights the various routes that can be taken by a vehicle as it travels from the central processing center to any of the authorized customers.

The present invention provides a system and method for computer-controlled, automated distribution of articles. With reference to FIGS. 1 and 2, the system is activated when an authorized customer 1, identified by a customer identification code or some other unique identifier, orders one or more articles from a central processing center 2 using an order communication means 10 which is compatible with the system. The authorized customer 1 may be, for example, an individual requiring articles for his/her personal use or a business entity.

The article(s) ordered by the authorized customer 1 are distributed from the central processing center 2 to the destination specified by the authorized customer 1 through the underground transport system illustrated in FIG. 2. In the embodiment of the present invention illustrated in FIGS. 1 and 2, the central processing center 2 functions as the data focal point of the entire system. It co-ordinates the various computer networks and software programs required to efficiently run and maintain the automated article distribution system of the present invention.

FIG. 2 represents a simplified diagram illustrating the arrangement of the underground transport system of the present invention. The underground transport system consists of an interconnecting underground tunnel network 12 which is capable of transporting vehicles 15 between the central processing center 2 to a location specified by an authorized customer 1 for delivery of the ordered articles. The underground nature of the interconnecting tunnels of the present invention allow the system to serve all addressable locations and so service a diverse range of authorized customers located over a defined geographical area such as a town, city or county.

The central processing center 2 which is in constant communication with sensor modules 11 located throughout the underground tunnel network 12 programs the vehicles 15 with potential routes for reaching their destinations. In particular, FIG. 2 illustrates the numerous potential routes that can be taken by a vehicle 15 in order for it to arrive at its destination. For example, a vehicle 15 transporting articles from the central processing center 2 to an authorized customer 1 located at authorized customer location 18 can move along tunnel 19 to tunnel 20, join tunnel 21 to tunnel 22 via tunnel 25 and finally reach authorized customer location 18 at tunnel 23. Alternatively, the vehicle 15 could reach authorized customer location 18 by moving along tunnel 19 to tunnel 22 and directly join tunnel 23. If there is a traffic-related problem, e.g. congestion, on any of these two potential routes, this is sensed by the sensor module 11 and the vehicle 15 could then be directed to move along tunnel 24 from the central processing center 2 and join tunnel 25 or 26 and thereby reach tunnel 23 and authorized customer location 18.

Referring now to FIG. 1, the central processing center 2 is composed of a processing center 3, an authorized customer database 4, an authorized customer credit database 5 and a Distribution Command Center 6. The Distribution Command Center 6 comprises an article retrieval center 7, an article loading center 8 and a route information processing center 9. In FIG. 1, the Central Processing Center 2 is illustrated as a single integrated processing and distribution center. However, in other embodiments of the present invention, the components of the Central Processing Center 2 may be physically located in different regions of the system, e.g., in a different embodiment of the present invention there could be one or more remote Distribution Command Centers 6 under the control of a single Central Processing Center 2. In this embodiment vehicles 15 could be loaded and sent to the destination specified by an authorized customer 1 from one of a number of remote Distribution Command Centers 2 located throughout the underground tunnel network 12.

In the system of the present invention an authorized customer 1 may order articles using a variety of different order communication means 10. For example, the authorized customer 1 may order articles by telephone utilizing one of the numerous automated telephone systems known in the art of telecommunications. Alternatively, the authorized customer 1 may order articles by computer, for example utilizing an interactive computerized system similar to the menu-driven program and touch sensitive screen combinations currently used in automated banking services. Other order communication means 10 which would be compatible with the system of the present invention are known to those skilled in such fields as voice/data communications and intelligent call processing.

In the embodiment of the present invention illustrated in FIG. 1, the authorized customer 1 using one of a variety of order communication means 10 contacts the Central Processing Center 2. A processing center 3 located within the Central Processing Center 2 accepts the authorized customer's 1 ordering information and customer information. The processing center 3 verifies the customer information such as name, address, identifier code and previous ordering history by automatic communication with the authorized customer database 4. In addition, the processing center 3 has the capability to check the authorized customer's 1 credit history by communication with the authorized customer credit database 5. The information contained in the authorized customer credit database 5 can terminate the transaction if, for example, the authorized customer 1 is not up-to-date in payment of his/her bills. The customer credit database 5 can also act as a means for the authorized customer to pay bills. For example, by direct computer link to the authorized customer's 1 bank account it can electronically credit and/or debit the account as required by the various transactions. Alternatively, the customer credit database can complete the transaction by electronic communication with the authorized customer's credit card company.

Once all authorized customer information has been verified in the embodiment of the present invention illustrated in FIG. 1, the processing center 3 communicates with the Distribution Command Center 6 to coordinate the collection, loading and transport of the articles ordered by the authorized customer 1. After the articles have been loaded and transported, the processing center 3 automatically generates a record of the transaction and sends it to the authorized customer 1.

In the Distribution Command Center 6, the articles ordered by the authorized customer 1 are retrieved from a storage area in the Article Retrieval Center 7. The specific articles ordered by the authorized customer 1 may be retrieved from a storage area such as a warehouse by automatic or manual means. Systems for the automatic storage and retrieval of articles have been described previously, e.g. U.S. Pat. No. 4,950,119, the contents of which are incorporated herein by reference in their entirety.

Once the articles ordered by the authorized customer 1 have been retrieved they are loaded into vehicles at the article loading center 8 for automatic transport to the destination specified by the authorized customer 1. Vehicle loading may be accomplished by automatic or manual means. Robotic systems suitable for the automatic loading of articles into the vehicles are currently utilized in other industries.

Once loaded, the vehicle in the embodiment of the present invention shown in FIG. 1 then passes to the route information center 9. Using customer information generated by the processing center 3 and the authorized customer database 4, the route information center 9 programs the loaded vehicle with its primary route information. The primary route information represents the route information center's 9 determination of the shortest available route between the central processing center 2 and the destination specified by the authorized customer 1. At this stage, the route information center 9 can also program the vehicle with alternative routes (e.g., secondary and tertiary alternatives). The route information center 9 is in contact with various sensor modules 11 located throughout the underground transport network 12. The sensor modules 11 transmit data to the route information center 9 on a variety of topics related to vehicular traffic patterns and tunnel congestion. The route information center 9 has the capability to collate all the information coming from the various sensor modules 11 in order to design the most efficient route for the vehicle.

The loaded vehicle passes from the Distribution Command Center 6 into the underground tunnel network 12 where it is automatically transported to the destination specified by the authorized customer 1. In the embodiment of the present invention illustrated in FIG. 1, the vehicle 15 stops upon its arrival at the destination specified by the authorized customer 1, e.g. a private residence or business address. The vehicle 15 is then removed from the underground tunnel network 12 by a vehicle transfer system 13. The vehicle transfer system 13 transfers the vehicle 15 into a port which is situated along the length of the underground tunnel network 12. The vehicle transfer system 13 can be situated proximate the port for convenience. Means for signalling the arrival of the vehicle 15 to the authorized customer 1 such as an alarm or light can also be included in the system of the present invention. Such a signal would be activated by uptake of the vehicle 15 by the vehicle transfer system 13. Uptake of the vehicle 15 from the underground tunnel network 12 may be accomplished by the utilization of various mechanized means, e.g. robotic arms. Once in the port, the vehicle 15 is elevated into a designated unloading area of the authorized customer's 1 residence or business. Hydraulic lifts, a pulley system or a similar prior art system may be used to elevate the vehicle 15. Once elevated into the designated area for unloading, the vehicle 15 is unloaded. It is not necessary that the vehicle 15 be unloaded immediately upon its arrival in the designated area. Once in the vehicle transfer system 13, the vehicle 15 is removed from the underground tunnel network 12 and so it cannot block passage of other vehicles 15 as they pass through the tunnels to their designated destinations.

The port situated along the underground tunnel network 12 at the authorized customer's 1 residence or business may consist of a single or multiple port system. In the multiple port system the individual ports may serve as both entry and exit ports or they can be dedicated to only entry or exit. The arrangement of the port system is dependent on a variety of factors, e.g., the size of orders and/or the extensiveness of the authorized customer's 1 usage of the system.

Once unloaded, the vehicle 15 is passed into the underground transport system 12 by the authorized customer 1 and it is preferably returned to its point of origin. In the embodiment illustrated in FIG. 1, the vehicle 15 is preferably returned to the Distribution Command Center 6.

The route to be taken by the vehicle 15 for its return can be programmed by the vehicle return 14 or it can be pre-programmed at the Route Information Center 9. Systems for controlling the movement of a vehicle 15 in a tunnel network have been previously described, e.g. U.S. Pat. No. 4,554,873 and U.S. Pat. No. 5,063,857, the contents of which are hereby incorporated herein by reference in their entirety.

Movement of the vehicle 15 in the underground tunnel system 12 of the present invention can be facilitated by various means, e.g., electromagnetic, electric and gas are all possible power sources. The vehicle 15 of the present invention is any vehicle capable of receiving articles and computer-controlled, automatic, guided movement through an underground tunnel network 12. Vehicles 15 compatible with the system of the present invention have been described in the prior art, e.g. the vehicle of previously described U.S. Pat. No. 4,950,119, the contents of which are hereby incorporated herein by reference in their entirety.

The underground tunnel network 12 of the present invention can be equipped with rails (e.g. a two rail track suitable to guide wheeled vehicles) or it can be rail-less. If rail-less, the tunnels would have marked paths to guide the vehicle 15. These paths could be defined by guide rails inserted into the tunnel floor or by cables laid below the floor which develop an electromagnetic field which, for example, might effect control means on the vehicle 15 which would be equipped with suitable receiving equipment. In the rail-less embodiment of the present invention, the vehicle 15 may have a steering device.

Sensory modules 11 placed at numerous locations along the underground tunnel network 12 of the present invention are in communication with the route information center 9 and in one embodiment of the present invention may perform a dual function. They can fulfill their primary role which is to relay information regarding vehicular traffic conditions to the route information center 9 and, in addition, they can also interact with guidance sensors 16 placed on the vehicle 15. Such guidance sensors 16 interact with the route information center's 9 program. The vehicle sensors 16 interact with the sensory modules 11 in order to switch the path of the vehicle 15 from one tunnel to another within the underground tunnel network 12. Alternatively, such switching could be controlled directly by the route information center 9 and be performed by, for example, magnetic mechanisms as in U.S. Pat. No. 3,763,788, the contents of which are hereby incorporated herein by reference in their entirety.

The present invention also provides a method for computer-controlled automated distribution of articles whereby an authorized customer 1 using the system described above can order one or more articles and have them automatically delivered to a specified location, e.g. a home or business address.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follow in the spirit of the broad scope of the appended claims are included.

I claim:

1. A computer-controlled, automated shopping system for distributing an article from a processing center to an authorized customer upon demand comprising:

(a) ordering means, whereby an authorized customer can order a specific article from a processing center;

(b) underground distribution means including a transport system connecting said processing center with a delivery location specified by said authorized customer and a vehicle operable on said underground distribution means for automatically conveying said article from said processing center to said delivery location; and (c) means whereby said vehicle is thereafter returned to said processing center after unloading of said article at said delivery location;

said transport system comprising:

(a) an interconnecting underground tunnel network allowing movement of a vehicle between said processing center and said delivery location specified by said authorized customer;

(b) a port situated along the length of said underground tunnel network, said port corresponding to said delivery location specified by said authorized customer; and (c) vehicle transfer means positioned proximate said port, said vehicle transfer means capable of automatically removing said vehicle from said underground tunnel network and releasing said vehicle into said underground tunnel network.

2. The transport system of claim 1, wherein said vehicle comprises an unmanned wagon adapted for automatic, controlled movement within an underground tunnel network, said wagon being configured such that it can be loaded with at least one article.

3. The transport system of claim 1, wherein said vehicle is guided in said underground tunnel network on a rail guidance system.

4. The transport system of claim 1, wherein said vehicle is guided in said underground tunnel network on a rail-less guidance system.

5. The transport system of claim 1, wherein transport of said vehicle within said underground tunnel network is controlled by computer means.

6. A computer-controlled, automated shopping system for distributing an article from a processing center to an authorized customer upon demand comprising:

(a) an ordering means, whereby an authorized customer can order a specific article from a processing center;

(b) accounting means, whereby said authorized customer can pay for said article, said accounting means comprising account credit and/or debit means;

(c) retrieval means, whereby said article can be retrieved from a storage area and placed in a vehicle adapted for automatic transport within an underground distribution means;

(d) underground distribution means including a transport system connecting said processing center with a delivery location specified by said authorized customer and a vehicle operable on said underground distribution means for automatically conveying said article from said processing center to said delivery location;

(e) signalling means, whereby arrival of said vehicle at said delivery location is indicated; and (f) means whereby said vehicle is thereafter returned to said processing center after unloading of said article at said delivery location;

said transport system comprising:

(a) an interconnecting underground tunnel network allowing movement of a vehicle between said processing center and said delivery location specified by said authorized customer;

(b) a port situated along the length of said underground tunnel network, said port corresponding to said delivery location specified by said authorized customer; and (c) vehicle transfer means positioned proximate said port, said vehicle transfer means capable of automatically removing said vehicle from said underground tunnel network and re-entering said vehicle into said underground tunnel network.

7. The transport system of claim 6, wherein said vehicle comprises an unmanned wagon adapted for automatic, controlled movement within an underground tunnel network, said wagon being configured such that it can be loaded with at least one article.

8. The transport system of claim 6, wherein said vehicle is guided in said underground tunnel network on a rail guidance system.

9. The transport system of claim 6, wherein said vehicle is guided in said underground tunnel network on a rail-less guidance system.

10. The transport system of claim 6, wherein transport of said vehicle within said underground tunnel network is controlled by computer means.

11. A method for computer-controlled, automated shopping whereby an article can be distributed from a processing center to an authorized customer upon demand, comprising the steps of:

(a) receiving an order for an article from an authorized customer;

(b) placing said article in a vehicle adapted for automatic transport in an underground transport system;

(c) transporting said article in said vehicle to a predetermined destination specified by said authorized customer; and (d) returning said vehicle to said processing center after unloading of said article;

said transporting step further comprising an interconnecting underground tunnel network programming a vehicle for automatic movement between said processing center and said delivery location specified by said authorized customer through said underground tunnel network to a port situated along the length of said underground tunnel network corresponding to said delivery location specified by said authorized customer, and removing said vehicle from said underground tunnel network to permit said vehicle to be unloaded, and thereafter releasing said vehicle into said underground tunnel network for returning said vehicle to said processing center.

12. The method of claim 11, further comprising retrieving said article from a storage area.

13. The method of claim 11, further comprising signalling the arrival of said vehicle at said predetermined location.

14. A method for computer-controlled, automated shopping whereby an article can be distributed from a processing center to an authorized customer upon demand, comprising the steps of:

(a) receiving an order for an article from an authorized customer;

(b) retrieving said article from a storage area;

(c) placing said article in a vehicle adapted for automatic transport in an underground transport system;

(d) transporting said article in said vehicle to a predetermined destination specified by said authorized customer;

(e) signalling arrival of said vehicle at said predetermined location; and (f) returning said vehicle to said processing center after unloading of said article;

said transporting step further comprising an interconnecting underground tunnel network programming a vehicle for automatic movement between said processing center and said delivery location specified by said authorized customer through said underground tunnel network to a port situated along the length of said underground tunnel network corresponding to said delivery location specified by said authorized customer, and removing said vehicle from said underground tunnel network to permit said vehicle to be unloaded, and thereafter releasing said vehicle into said underground tunnel network for returning said vehicle to said processing center.

* * * * *